United States Patent [19]

Onishi et al.

[11] Patent Number: 4,963,926

[45] Date of Patent: Oct. 16, 1990

[54] ELECTROSTATIC IMAGE FORMING APPARATUS WITH CHARGE CONTROLLER

[75] Inventors: Kunihiro Onishi; Akihiro Takada, both of Osaka; Kaneyuki Sakamoto, Nara, all of Japan

[73] Assignee: Mita Industrial Co., Ltd., Osaka, Japan

[21] Appl. No.: 348,994

[22] Filed: May 8, 1989

[30] Foreign Application Priority Data

| | | | |
|---|---|---|---|
| May 12, 1988 | [JP] | Japan | 63-115073 |
| Aug. 31, 1988 | [JP] | Japan | 63-218886 |
| Nov. 30, 1988 | [JP] | Japan | 63-303071 |
| Feb. 22, 1989 | [JP] | Japan | 1-42583 |

[51] Int. Cl.[5] ..... G03G 21/00; G03G 15/02

[52] U.S. Cl. ..... 355/203; 355/204; 355/210; 355/219

[58] Field of Search ..... 355/210, 239, 219, 216, 355/204, 203

[56] References Cited

U.S. PATENT DOCUMENTS

| | | | |
|---|---|---|---|
| 4,326,796 | 4/1982 | Champion et al. | 355/219 X |
| 4,420,247 | 12/1983 | Suzuki et al. | 355/219 X |
| 4,484,811 | 11/1984 | Nakahata et al. | 355/210 X |
| 4,502,777 | 3/1985 | Okamoto et al. | 355/210 X |
| 4,800,337 | 1/1989 | Cox et al. | 355/204 X |

FOREIGN PATENT DOCUMENTS

| | | | |
|---|---|---|---|
| 0066445 | 5/1982 | Japan | 355/219 |
| 0163240 | 10/1982 | Japan | 355/216 |
| 0100154 | 6/1983 | Japan | 355/219 |
| 0120269 | 7/1983 | Japan | 355/219 |
| 0120270 | 7/1983 | Japan | 355/219 |
| 0122571 | 7/1983 | Japan | 355/219 |

*Primary Examiner*—Arthur T. Grimley
*Assistant Examiner*—Nestor R. Ramirez
*Attorney, Agent, or Firm*—Koda & Androlia

[57] ABSTRACT

The following is in reference to the electrostatic copying machine with image formation apparatus using the photo conductor.

The invention is to compute the electrifier voltage that is able to get the desired charge at the developing section by detecting the charge capacity and potential falling amount in order to correct the change in charge amount affected by the potential falling. The invention is that the correction can be made even in the course of continuous processing and in order not to be affected by the aged deterioration of the photo conductor, memorize the voltage per photo conductor temperature after the correction of the processed number of sheets and renew the memory value with the latest data. The invention is that the degree of the potential falling by the temperature of photo conductor is affected by the quantity of light irradiated on the photo conductor—to change the degree of correction of potential falling in proportion to the temperature of the photo conductor. And, the invention is that the charge capacity is detected timely and that a memory to store the relation between the photo condcutor temperature and the potential falling characteristics is equipped, in order not to be affected by the aged deterioration of the photo conductor and the temperature dependability of the potential falling.

3 Claims, 15 Drawing Sheets

(a)

(b)

(c)

(d)

ELECTROSTATIC IMAGE FORMING APPARATUS WITH CHARGE CONTROLLER

BACKGROUND OF THE INVENTION

1. Field of the Invention

The invention is in relation to electrostatic image formation apparatus and in particular, refers to the adjustment of electrifier which charges the surface of the photo conductor.

2. Description of the Prior Art

Electrostatic image formation apparatus as a background of the invention, charges the photo conductor by the applied voltage on electrifier installed along the rotating photo conductor, and this apparatus is of the type that produces an electrostatic latent image by projection of light on the charge. Such electrostatic latent image is developed by the toner when passing through the developing section. In order to apply the toner to the electrostatic latent image, it is the condition that the electric potential of the charge given to the photo conductor is adjusted at the fixed rate. For example, a certain copying machine is required a potential difference of more or less 800 V.

The charge on the surface of such photo conductor is usually supplied by corona discharge brought about by the applied voltage of the electrifier. Under the circumstances, an apparatus to project the light have to be installed between the developing devices and said electrifier. Therefore, the electrifier is placed a little away from the developing device.

In recent years, however, photo conductors made of amorphous silicon are used very frequently by reason of their non-pollution and high durability. However, photo conductors made of amorphous silicon have a fault that are inferior in the characteristics of the potential falling to the other photo conductors.

Therefore, in copying machines and like for which electrifiers are placed a little away from the developing section, electric potential falls by tens of volt from the point when charged by corona discharge till the arrival at the developing section, and as the results, photo conductors of amorphous silicon had a fault that a desired electric potential cannot be secured for the most suitable photographic image density at the developing section.

Therefore, for example, in the electronic photograph image formation apparatus which appears in the Government Bulletin No. Japanese Laid-Open Patent Publication (unexamined) No. 61-281258, photo conductors are charged for a fixed amount before the actuation for the formation of image and at the time the part charged arrived at the position of the surface electric potential sensor, said apparatus stops the rotation of the photo conductor for a fixed time and detect the potential falling characteristics of the photo conductor.

As stated above, the characteristics of potential falling can be measured, but, in fact, the relation (charge characteristics) between voltage charged on electrifier and charge amount generated by photo conductor as the result is changed, charge amount desired at the developing section can not be obtained.

Such relations between voltage charged on electrifier and charge amount generated on photo conductor, depend on ambient atmospheric temperature, deterioration with the lapse of time of photo conductor and the like and besides, the fact is well known that there are a great deal of dispersion in said relation of the individual photo conductors.

In the corona current setting system appearing on the Government Bulletin No. Japanese Laid-Open Patent Publication (unexamined) No. 60-55363, taking note of the dispersion owing to change of the ambient atmospheric temperature as given above, a data table is prepared calling for the relations between the ambient atmospheric temperature and charge amount caused according to the voltage to be fixed and the voltage of electrifier is adjusted in accordance with the change of ambient atmospheric temperature on the strength of the above information of data table.

The current setting system appearing on the above Government Bulletin No. Japanese Laid-Open Patent Publication (unexamined), has superiority in that the adequate electrifier voltage (charge characteristics) can be set in accordance with the change of ambient atmospheric temperature. On the other hand, however, as stated already, the relation between electrifier voltage and charge amount generated on the surface of photo conductor drastically change not only by the change of the ambient atmospheric temperature, but also by the dispersion of the characteristics of the individual photo conductors and its aged deteriorations. In the circumstances, a means for copying with all the changes, as stated on the Government Bulletin No. Japanese Laid-Open Patent Publication (unexamined) No. 60-55363, the method to prepare data table in advance requires a huge amount of memory capacity and at the same time, complicates the programs for operation and logical judgement and is not economical.

Accordingly, the first object of this invention is to keep up with the change of photo conductor characteristics without preparing data table for the cause of change.

As above, the amount of potential falling changes exorbitantly with the lapse of time, and the error becomes a large amount without the use of the latest measured value. On top of that, the amount of potential falling will rely to a great extent, on the temperature of the photo conductor. Therefore, it is advisable to revise the amount of potential falling in conformity with the change of temperature of photo conductor at the time the continuous copying process is performed.

In the advanced technology disclosed in the Government Bulletin No. Japanese Laid-Open Patent Publication (unexamined) No. 60-55363, however, the charge performance data table is only the item prepared and potential falling characteristics is not thus resulting in the inability to the accurate revision of potential falling and besides, it was not able to renew the data table to catch up with change in the lapse of time.

For that reason, the second object of this invention is to offer the image formation apparatus that have the following features; the amount of revision can be changed for the potential falling in order to follow the aged deteriorations of the photo conductor and at the same time, an adequate revision for the potential falling to keep up with the temperature change of photo conductor in the course of continuous copy processing.

The FIG. 11 shows an example with a graph of the condition of the fall of electric potential (potential falling) for $\Delta t$ seconds of photo conductor surface. Generally as shown in FIG. 11, the manuscripts in "Solid black" and in "Intermediate tone" are different in their amount of electric potential falling for the photo conductor's fall of potential and we can see a change in the amount of electric potential falling for the fall of potential caused by the change of the temperature in photo conductor.

In order to bring the value of electric potential of the photo conductor surface to the desired value, several methods have been studied to control an applied level of electric potential of the aforesaid electrifier higher by the amount of potential falling of photo conductor and in this case, said level should be controlled usually the above electrifier applied voltage to get the desired image density of "Solid black."

The FIG. 9 shows the electric potential of photo conductor at the developing section when the above-mentioned conventional electrostatic image formation apparatus is used.

As per the Fig., the electric potential of photo conductor for "Solid black" at the developing section is now controlled to be objective electric potential (e.g., 800 V).

However, the electric potential of the photo conductor for "Intermediate tone" at the developing section will be away to a great extent from the objective electric potential (e.g., 250 V) with a raise of temperature of photo conductor.

Therefore, the picture appearance quality will be drastically deteriorated at the "Intermediate tone" on account of the unavailability of the desired image density.

The FIG. 10 shows the electric potential at the developing section when controlled to secure the desired image density at the "Intermediate tone."

In this case, the electric potential of photo conductor is controlled at 250 V of the objective electric potential at the developing section. However, as shown in the drawing, the electric potential of photo conductor for "Solid black" will be away to a great extent from 800 V of objective electric potential with a raise of temperature of photo conductor.

Accordingly, the picture appearance quality will be drastically deteriorated by the non-availability of the desired image density in the "Solid black."

Consequently, this invention's third object is to offer the electrostatic image formation apparatus that can get the desired image density, in both the "Solid black" and "Intermediate tone" even in the change of photo conductor temperature.

As previously stated, it is a fact well-known that the amount of potential falling of photo conductor and charge characteristics are changeable with several causes. On the contrary, as mentioned before, the amount of potential falling rely heavily on the temperature of photo conductor and accordingly changes to a great extent, and charge characteristics is also changeable on a vast scale according to the degree of deterioration (Deterioration with a lapse of time) of photo conductor.

Therefore, the fourth object of this invention is the charge characteristics of photo conductor which is to be measured timely at the time power source is set on, and at the finish of image processing and another is the amount of potential falling, an accurate voltage value of which is to be figured out by referring to storage cell in proportion to the temperature of photo conductor.

SUMMARY OF THE INVENTION

It is hence a primary object of this invention to present an electrostatic image formation apparatus in which a photo conductor is charged by an electrifier provided in the vicinity of the photo conductor rotating, an electrostatic latent image is formed by projecting light to said charge, and said electrostatic latent image is developed into a toner image by applying toner thereto at a developing section, said apparatus is characterized by comprising voltage adjust means for adjusting voltages $V_1$, $V_2$ to charge an electrifier in order to charge a surface of a photo conductor in several different values, electric potential detect means for detecting electric potentials $E_1$, $E_2$ on the surface of a photo conductor that correspond to the electric voltages $V_1$, $V_2$ of said electrifier by a surface electric potential sensor installed in the neighborhood of a surface of a photo conductor, potential falling amount detect means for detecting the amount of potential falling $\Delta E$ of the charge applied to a surface of said photo conductor by the electric potential sensor within a specified time, and voltage computing means for calculating a voltage to be applied to said electrifier according to each voltage $V_1$, $V_2$, each detected electric potential $E_1$, $E_2$ and the amount of potential falling $\Delta E$ in order to get a required surface charge.

It is hence a second object of this invention to present an electrostatic image formation apparatus in which a photo conductor is charged by an electrifier provided in the vicinity of the photo conductor rotating, an electrostatic latent image is formed by projecting light to said charge, and said electrostatic latent image is developed into a toner image by applying toner thereto at a developing section, said apparatus is characterized by comprising a storage cell that can be read and written on demand, data entry means for entering data as the number of sheets processed, electrifier voltage value which includes revised amount of potential falling caused between a measured position of surface electric potential of photo conductor and a developing unit in said storage cell for each temperature of the photo conductor, data renewal means for renewing the data written by said data entering means basing on a rule to cope with said number of sheets processed, and voltage decision means for deciding a voltage value of electrifier to cope with temperature of said photo conductor in the course of processing a image formation basing on the data written in said storage cell.

It is hence a third object of this invention to present an electrostatic image formation apparatus in which a photo conductor is charged by an electrifier provided in the vicinity of the photo conductor rotating, an electrostatic latent image is formed by projecting light to said charge, said electrostatic latent image is developed into a toner image by applying toner thereto at a developing section, said apparatus is characterized by comprising potential falling amount detecting means for detecting the amount of potential falling in the specified time of the charge with the use of surface electric potential sensor which is installed in the periphery of the surface of photo conductor after charging the surface of photo conductor by said electrifier applied specified voltage, potential falling amount revision means for revising the amount of potential falling detected by said potential falling detecting means by selecting to apply the revised expression in accordance with the detected temperature by a temperature sensor in detecting said photo conductor temperature, and applied voltage computation means computing the applied voltage of electrifier by adding the revised amount of potential falling by way of said potential falling amount revision means onto the specified standard applied voltage.

It is hence a fourth object of this invention to present an electrostatic image formation apparatus in which a photo conductor is charged by an electrifier provided in the vicinity of the photo conductor rotating, an electrostatic latent image is formed by projecting light to said charge, and said electrostatic latent image is developed into a toner image by applying toner thereto at a developing section, said apparatus is characterized by comprising voltage adjust means for adjusting voltages $V_1$, $V_2$ to charge an electrifier in order to charge the surface of a photo conductor in several different values, electric potential detect means for detecting electric potentials $E_1$, $E_2$, on the surface of photo conductor that correspond to electric voltages $V_1$, $V_2$ of said electrifier and installed in the neighborhood of the surface of photo conductor, photo conductor temperature detect means for measuring photo conductor temperature T to be installed in the neighborhood of the surface of photo conductor, memory means for storing the function or table in advance to show the relation of the temperature of photo conductor vs. potential falling characteristics, and voltage computing means for calculating a voltage to be applied to said electrifier according to each voltage $V_1$, $V_2$, each detected electric potential $E_1$, $E_2$, photo conductor temperature T, and said function or table in order to get a required surface charge.

The specifications particularly point out the main subject and end in a claim to claim. It is hoped that the following statement with reference to the attached Figs. will be helpful to understand.

BRIEF DESCRIPTION OF THE FIGURES

The FIG. 1 is a block diagram of electrifier voltage adjust circuit in the electrostatic image formation apparatus in connection with the embodiment of this invention, The FIG. 2 is the flow chart to show the electrifier voltage adjust procedures in the above electrostatic image formation apparatus, and (a) is main routine (b)–(e) are subroutines used in the above main routine, The FIG. 3 is a graph to show the relation between the electrifier voltage and surface electric potential, The FIG. 4 is a graph to show an example of the potential falling amount of surface electric potential, The FIG. 5 is a reproduced chart of an example of data table of storage cell at the time of entering the number of sheets copies and electrifier voltage value per temperature, The FIG. 6 is a flow chart of another embodiment to show the procedures of electrifier applied voltage computing process of the electrostatic image formation apparatus, The FIG. 7 is a graph to show an example of the relation between the potential falling amount and the revised potential falling amount, The FIG. 8 is to show the photo conductor electric potential in the developing section of the electrostatic image formation apparatus stated above, The FIG. 9 is a graph to show the photo conductor electric potential in the developing section of the electrostatic image formation apparatus, The FIG. 10 is a graph of an example to show the photo conductor electric potential in the developing section at the time of controlling to save the desired image quality of the "Intermediate tone,"

The FIG. 11 is a graph to show an example of potential falling characteristics of photo conductor electric potential, The FIG. 12 is a flow chart of one other embodiment to show a procedure in computing the electrifier voltage of the electrostatic image formation apparatus, and The FIG. 13 is a graph to show an example of temperature vs. potential falling characteristics.

DETAILED DESCRIPTION OF THE PREFERRED EMBODIMENT

Figure 1:
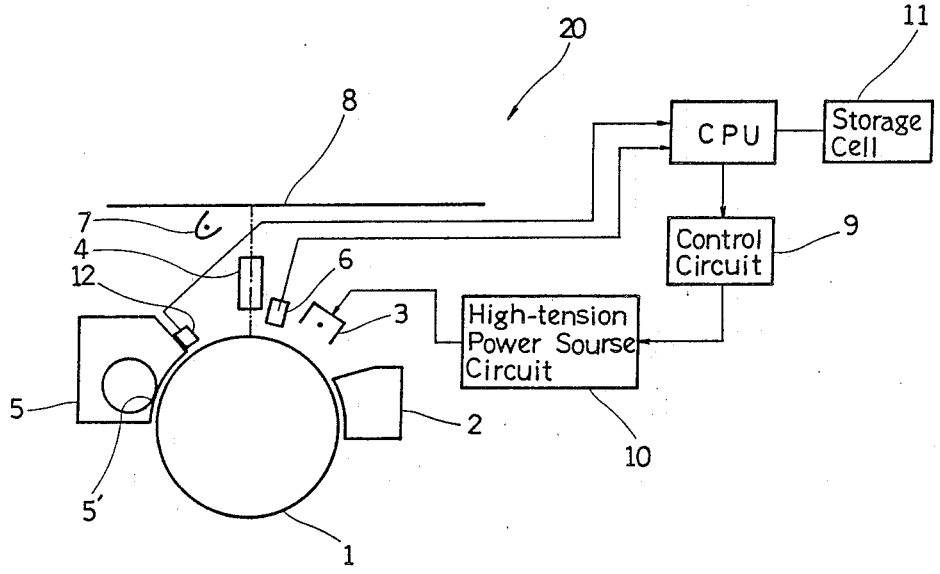

First of all, beginning with the explanation about the composition of the preferred embodiment of this invention, a block diagram of electrifier voltage adjust circuit is used to be shown in the FIG. 1. Photo conductor drum 1 is rotated by a motor which is not shown in the Fig.

In the periphery of the above photo conductor drum 1, cleaning unit 2, electrifier 3, "SELFOC" lens (Nippon Sheet Glass Co., Ltd.) array 4 and developing unit 5 are installed in the order of the above. Surface electric potential sensor 6 is installed between the above electrifier 3 and optical lens array 4, to detect the surface charge of photo conductor drum 1 charged by electrifier 3.

Thermistor 12 is installed to detect the photo conductor temperature in the periphery of the developing unit 5.

The above optical lens array 4 is to form an image of light reflected only on the manuscript 8, from the light projected from the light source 7, on the surface of the above photo conductor drum 1.

Signals from the above surface electric potential sensor 6 and thermistor 12 are data-processed with a microcomputer CPU and are, as occasion demands, entered into storage cell 11 that can be read and written. Microcomputer CPU sends a signal to high-tension power source circuit 10 by way of control circuit 9 and high-tension power source circuit 10 adjusts the voltage charged on electrifier 3 or performs ON/OFF control of the voltage in response to the signal from microcomputer CPU.

Figure 2:
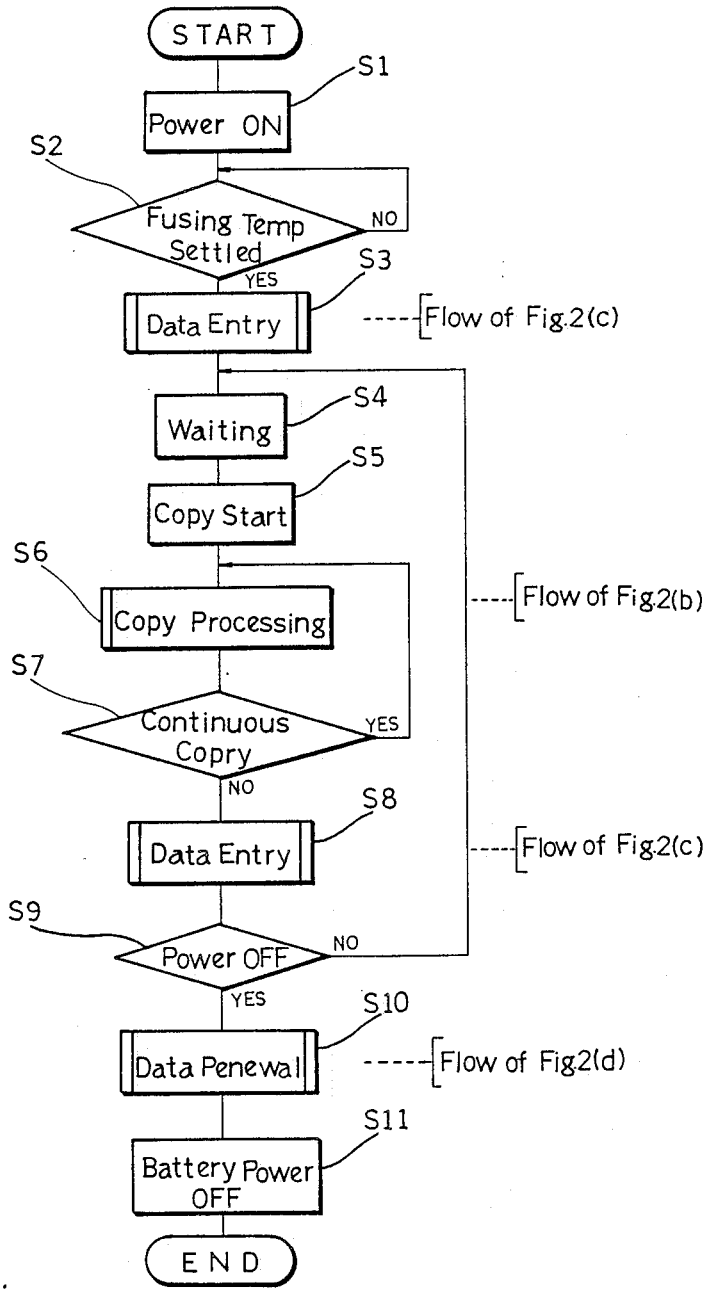
Figure 2:
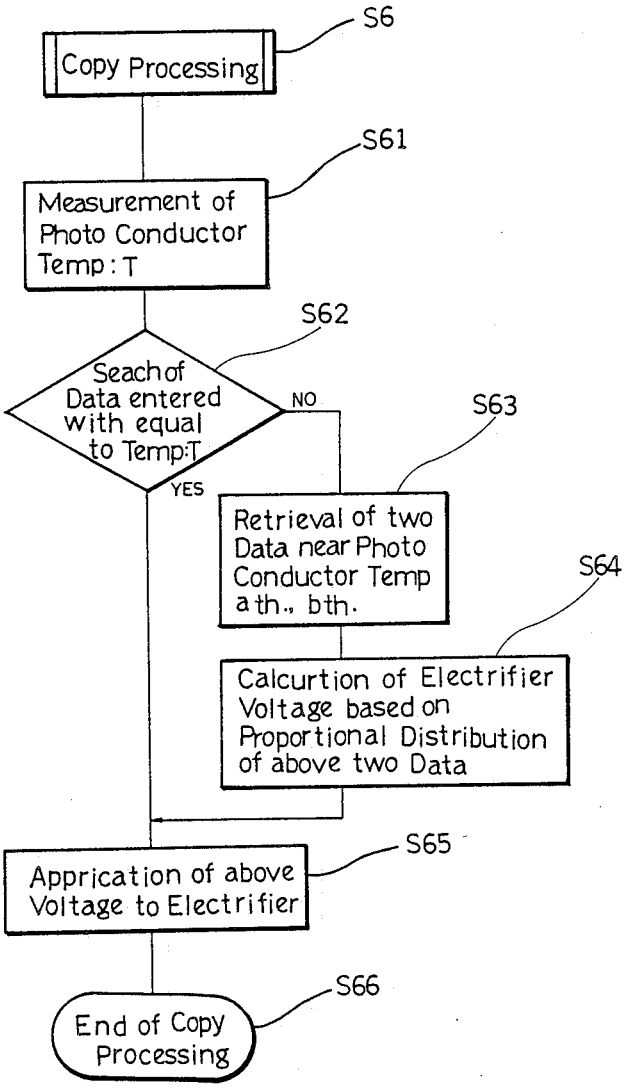
Figure 2:
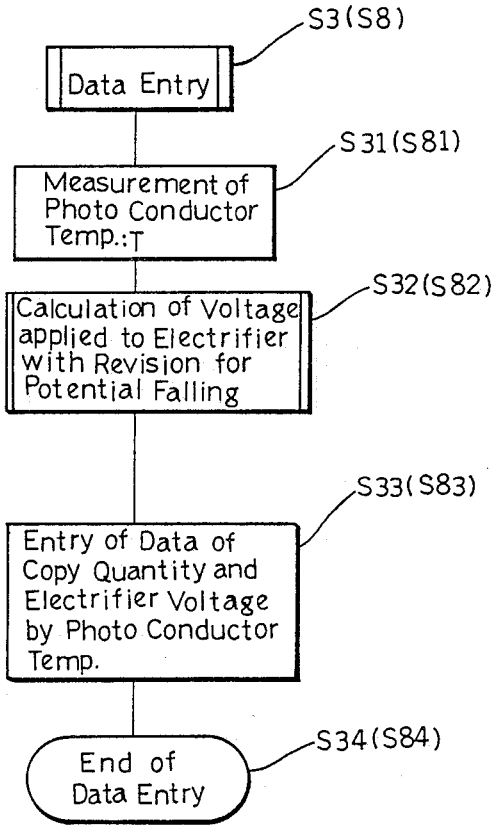
Figure 2:
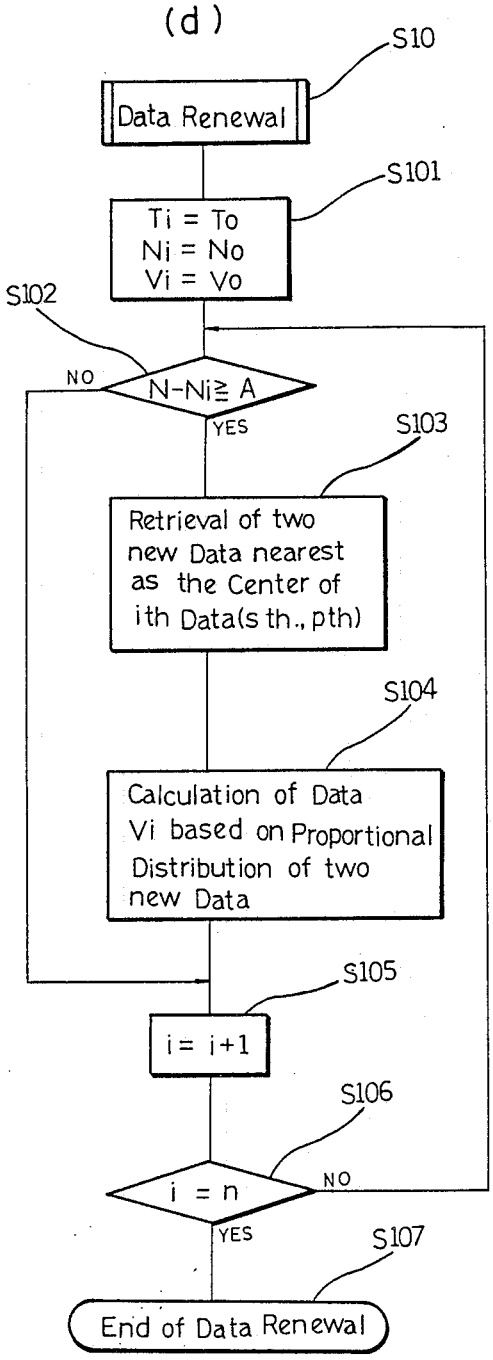
Figure 2:
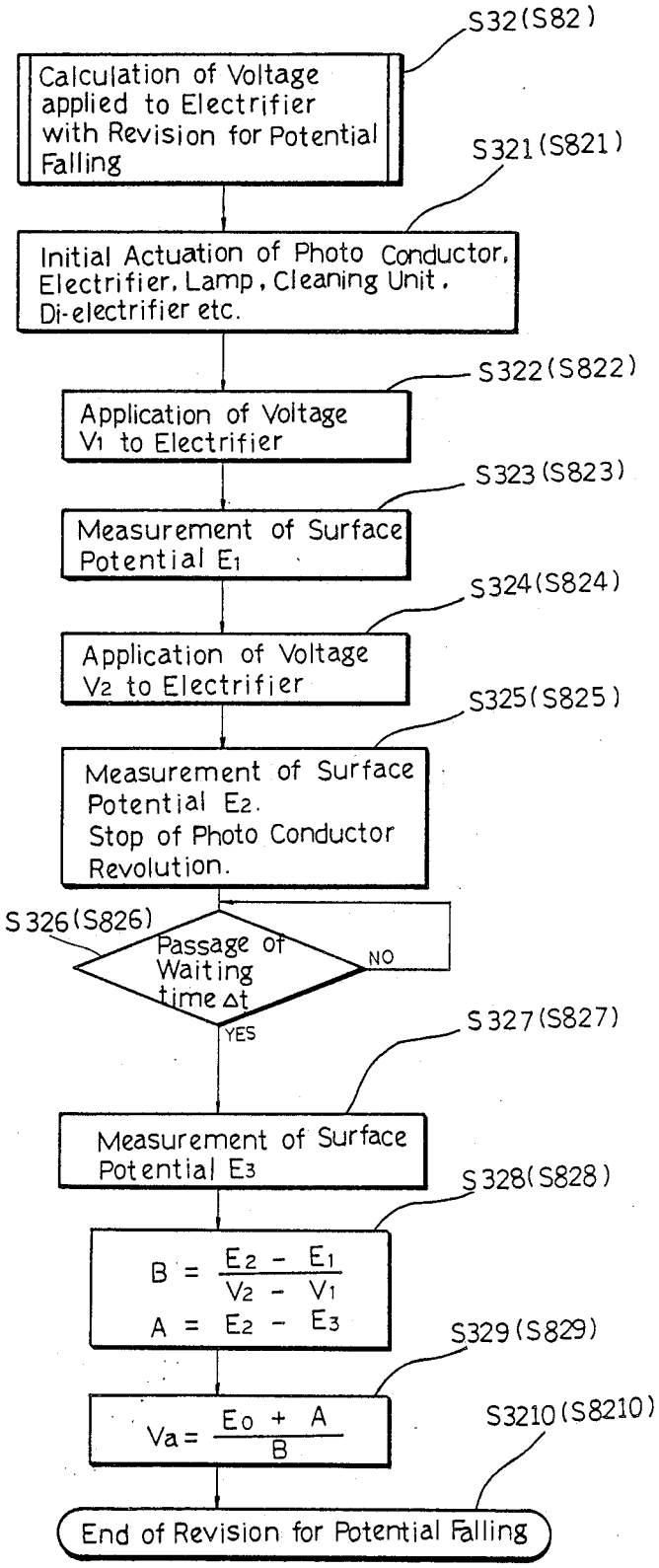

In the next place, referring to the FIG. 2 (*a*)–(*e*), the control procedures of electrifier 3 with the above microcomputer CPU are described.

Furthermore, it is noted that the numbers S1, S2, . . . appearing in the following explanation shows the processing procedures.

First of all, potential falling amount revision sub-routine process is described with the FIGS. 2 (*e*), 3, and 4.

First, in the S321, the operation as the initial motion drive source of photo conductor drum 1 is started, high-tension power source circuit 10 of electrifier 3, and other several varieties of lamp, cleaning unit, di-electrifier and the like.

And next in the S322, voltage $V_1$ is charged on electrifier 3 by the operation of high-tension power source circuit 10. Electric potential $E_1$ performed on the surface of photo conductor drum 1 is measured at the time when passing surface electric potential sensors 6 with the rotation of photo conductor drum 1. (S323).

Next, changing the electrifier voltage to $V_2$, the corresponding surface electric potential $E_2$ is measured (S324, S325) as the procedures S322, S323 and concurrently the revolution of the photo conductor drum 1 is made stop (S325).

Voltages $V_1$, $V_2$ charged on the above electrifier 3 were stored in microcomputer CPU and surface electric potential $E_1$, $E_2$ measured with surface electric potential sensor 6 is also stored in microcomputer CPU with a signal from the same sensor.

Rotations of photo conductor drum 1 stop for Δt seconds in this condition. The length for Δt seconds is fixed for the time required to travel for a part of the surface of photo conductor drum 1 from the place facing to the above surface electric potential sensor 6 to the developing section 5' of the developing unit 5.

Therefore, after an elapse of waiting time Δt, by measuring again the same portion of surface electric potential $E_3$ with surface electric potential sensor 6, the part where the surface electric potential was $E_2$, is measured the electric potential $E_3$ as if arrived at the above developing section 5' after passing the surface electric potential sensor 6 (S326, S327).

At this point in time, the microcomputer CPU figures out the ratio (charge capacity $B=(E_2-E_1)/(V_2-V_1)$), and the potential falling amount $A=E_2-E_3$ for Δt minutes (S328), and the above is, after all, a means for detecting the potential falling amount. The charge capacity B is, as shown in the FIG. 3, the ratio of the change of surface electric potential against that of electrifier voltage (lean of straight line l).

Therefore, if we name the electric potential as $E_0$ that corresponds the charge got at the developing section 5', the voltage Va charged to electrifier 6 which is necessary to generate such electric potential $E_0$, $$Va=(E_0+A)/B \quad (1)$$

can be computed (S329). One of the examples of voltage computation means is the above.

Figure 4:
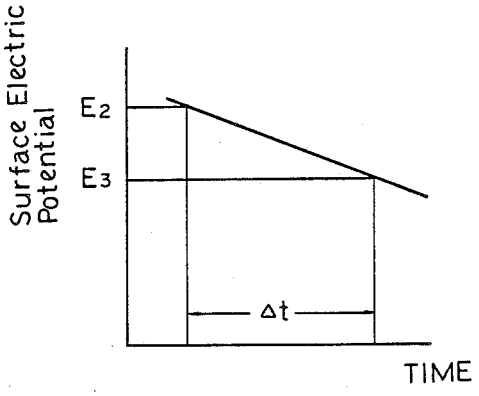

The FIG. 4 is to show an example of potential falling characteristics. The example of Fig. is shown on the assumption of the falling in straight line, but if the falling is in curved line, it is possible to revise to cope with the curved line.

Figure 3:
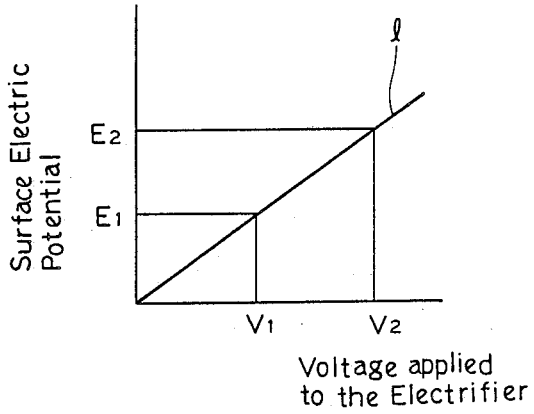

Moreover, the relation between voltage of electrifier and surface electric potential of photo conductor, as in the FIG. 3 is shown on the assumption of the proportional condition, but in case actually not in the proportional condition. The Y intercept of Y axis (surface electric potential axis) is found out against straight line l which runs through coordinates ($E_1$, $V_1$), ($E_2$, $V_2$) from $V_1$, $V_2$, $E_1$, $E_2$ and use it in the computation of equation as (1).

In the above example, voltages $V_1$, $V_2$ were applied at two different positions of the surface of photo conductor drum 1, but once di-electrified at light source 7, the charge can be loaded at the same location with a rotation of the photo conductor drum 1. By the di-electrifying at the above light source 7, adhesion of toner on the charge for detection of potential falling amount can be prevented.

Needless to say, it is possible to set up the location to load the charge beyond the boundary of image formation area. With the above, subroutine process for the revision of potential falling amount shall come to the end (S3210). According to the revision processing (S321–S3210) of the above potential falling amount, an appropriate applied voltage can be obtained at that point in time. Therefore, this processing independently is able to get the appropriate voltage that is not affected by the temperature of photo conductor 1, photo conductor deterioration degree and the like.

In the circumstances, without preparing the data table, the first object of this invention that can stand for all the changes of condition is achieved. As the above potential falling amount revision subroutine is to measure the actual charge characteristics and potential falling amount by actually applying voltage on the photo conductor 1, the above subroutine has superiority in finding an accurate voltage to apply not-withstanding the temperature of photo conductor 1, deterioration of photo conductor 1 and all the other causes of changes. But this can not be carried out in the course of processing a great number of continuous image formation, because the process requires to rotate the photo conductor and to load the charge. For that reason, if the change of surface temperature of photo conductor 1 comes out as the result of continuous image processing for a long time, once stop the image processing and measure again the potential falling amount, though this is troublesome work.

The next embodiment is an improved one in this respect and in the course of continuous image processing, appropriate apply of charge in response to the changes of temperature of photo conductor 1 can be made and at the same time, can cope with the deterioration of photo conductor 1 with a lapse of time and with all the above, achieves the second object of this invention. In the explanation of this embodiment, the FIG. 2 (*a*)–(*e*) and the FIG. 5 are chiefly used.

First, in the main routine of the FIG. 2 (*a*), the switch of power source is turned on (S1) and the process waits until the fixing temperature is settled (S2). After the settling of fixing temperature, the subroutine process is carried out to enter the data in the FIG. 2 (*c*) for the data entering step (S3) which is a means of data entering.

That is to say, the photo conductor temperature T is measured with thermistor 12 (S31). Next, in order to carry out the step (S32) to find electrifier voltage value with the revised potential falling value, the potential falling amount revision subroutine procedure is performed up to the steps of S321 –S3210 as in the aforementioned FIG. 2 (*e*). Explanation of this subroutine was given already in that here we omit the explanation. After that, the total number of all the sheets copied is entered up to the present (so-called number of sheets endured for copying), and the revised electrifier voltage value which come out of step S32 of revising the potential falling amount, into the storage cell 11 per temperature measured with S31 (S33). That is to say, the above is a means for entering the data.

Figure 5:
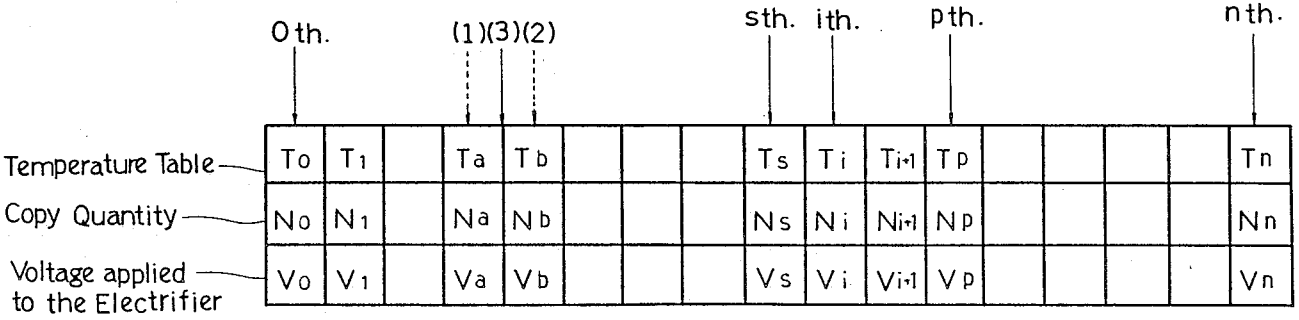

In this case, if such form is used as to enter the data per temperature step by step, as shown on the FIG. 5, into storage cell 11, enter the temperature as it is when the present photo conductor temperature conforms with temperature in data table, the temperature, number of sheets copied and electrifier voltage value. In the event there is no record of the present photo conductor temperature in data table, the temperature, the number of sheets copied, and electrifier voltage value are entered, after the appointed arithmetic process (e.g. raise to a unit: lower to a unit) prearranged to cope with the data table.

The procedure returns again back to the main routine as the data entering subroutine process is finished (S34).

In this way, after the data entry step (S3) as given on the FIG. 2 (*a*), turn to the condition of waiting for copy (S4). A switch button of copy-start which is not shown on the Fig. is pushed, then the copying actuation is started (S5) and copying process step is performed (S6).

The FIG. 2 (*b*) shows the copy process subroutine to perform this copy process.

That is to say, the photo conductor temperature T is measured at this point in time with thermistor 12 (S61).

Next, the measured temperature T of photo conductor and the temperature in temperature table entered already in storage cell 11 are checked (S62). At this time, if photo conductor temperature T measured in accordance with (1) shown by an arrow of broken line on the FIG. 5, is in conformity with the temperature Ta on the temperature table that filled already in the storage cell 11, voltage Va is applied on the electrifier 3 in the next step S65. Supposing that the temperature T of photo conductor 1 does not match the temperature of temperature table that already entered in storage cell 11 (case of (3) shown by an arrow of solid line on the FIG. 5), reference is made to the two pieces of data (data (1) of a-th position and data (2) of b-th position) in the periphery of the measured temperature of photo conductor 1 (S63). Next, the electrifier voltage is found out from proportional distribution and the like of temperature from the 2 pieces of data (S64). This is an example of a means for deciding the copying voltage. And, the voltage obtained from the proportional distribution is applied on the electrifier 3 in the step S65.

The procedure returns back to main flow after the finish (S66) of copy process with the applied voltage. At the point in time the copy processing step (S6) in the main flow of the FIG. 2 (*a*) is over, if addition of continuous copying is necessary. The procedure returns again to the copy processing step (S6) and the continuous copying continues and if not necessary to copy continuously. The process proceeds to the next step (S7).

Next step S8 of entering the data is performed soon after the copy processing step S6 and the continuous copy step S7, or on the basis of the time schedule optionally prearranged with an interval of a fixed waiting time, etc.

This step to enter data is made up of that of S81, S82 of S8 which is shown in number in (S821,—S8210 of flow on the FIG. 2 (*e*)) of flow on the FIG. 2 (*c*) and the step of S83, S84 of the flow on the FIG. 2 (*c*), and is completely same as the steps S31–S34 of data entering step S3 as already stated. Next, if the power source is cut off in the main flow of the FIG. 2 (*a*) (S9), the process of data renewal subroutine of the FIG. 2 (*d*) is carried out by way of power source from battery, using the means for renewing the data basing on a fixed rule to cope with the number of sheets to be copied (S10). If the power source remains unchanged, the process returns back to the waiting step S4, and the same procedure is repeated.

One by one explain the process (S10) of data renewal subroutine of the FIG. 2 (*d*).

In the process of data renewal subroutine (S10) to practice the data renewal means, as shown on the FIG. 5, start the renewal (S101) referring to the data from 0-th position (i.e. from i=0) of data table in the storage cell 11 at the time when the number of copy sheets per temperature and the value of electrifier voltage were entered. The count value Ni is found out, that the difference of the count value N between the present number of sheets copied and the count value Ni, of the number of sheets copied of the i-th data table is bigger than the fixed number of sheets A optionally prearranged. If come across the data Ni (S102) which is by A sheets older than the present, two pieces of fairly new data, for instance, S-th position and P-th position shown in the data table of the FIG. 5 (S103), that the difference with the present number N of sheets copied is less than A sheets and in the periphery of the data of i-th position, reference is made to S-th position and P-th position. Basing on the two pieces of new data, find the electrifier voltage $V_i$ for renewal in the i-th position from the temperature proportional distribution and the like (S104).

And the process proceeds to the next step (S105), the data of the next number is checked in the same manner and is checked one by one up to the last number i=n of the temperature table (S106).

Furthermore, the count value Ni of which the value of N-Ni is smaller than the value of the above-mentioned fixed number A of sheets is not necessary to renew as the data is up to date, and the step of S105 is performed omitting the step of S103, S104.

The data as the fundamentals of renewal of the aforesaid data is prepared to a certain extent at the time of adjustment for delivery and adjustment for installation. Therefore, there is no such inconvenience that is unable to compute the renewal data because of the scarcity of the fundamental data.

When the renewal of data is over (S107) as per the above, the procedure returns to the main flow as shown on the FIG. 2 (*a*), and the power source of the battery shall be placed to the OFF (S11).

Furthermore, the calculation method in the proportional distribution of the afore-mentioned S64, S104 will be OK by the use of approximate calculation in line with the reality in any way and can be selected freely.

Moreover, we used the rule on the basis of the number of sheets copied, but, in respect of the method to renew the data, it is free to select the calendar basis and the others.

Further explanation is given in connection with the preferred embodiment of this invention. Embodiment that has been told up to now presented us the object to deal with the potential falling under the condition (Solid black) that the light has no been projected at all on the photo conductor 1. However, the degree of potential falling in the photo conductor should vary with the amount of light projected on the part charged. This embodiment is prepared with function or table to find a corrected potential falling amount ΔEa for the computation of the appropriate voltage Va to charge the electrifier 3 from the potential falling amount ΔE detected in a fixed time, in order to be able to get the preferred image density in both "Solid black" and "Intermediate tone" in the changes of temperature of photo conductor 1, in view of the difference if the potential falling is to be corrected for the density (e.g. solid black, intermediate tone) of the manuscript.

Figure 6:
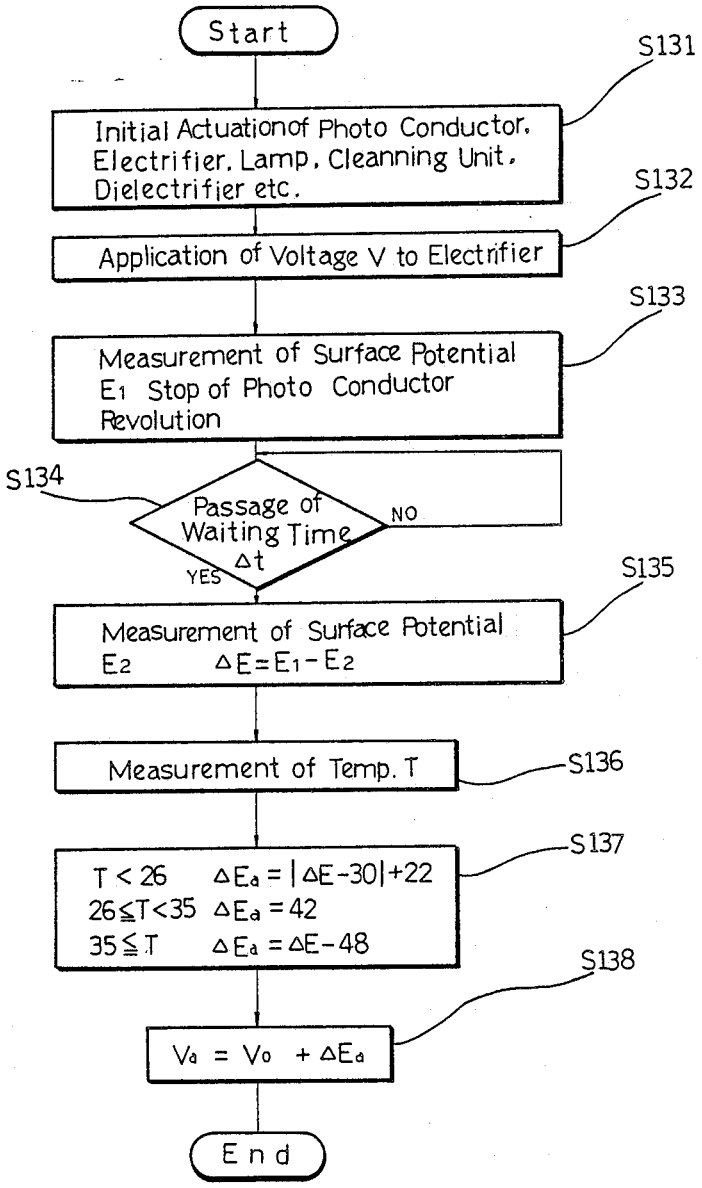

In the following, referring to the FIG. 6, the explanation is made on control procedures of electrifier 3 with the above microcomputer CPU in this embodiment.

S131, S132, . . . in the explanation to follow show the number of the processing procedures (step).

First, as the initial actuation of S131, the operations are made start for the driving source of photo conductor 1, high-tension power source circuit 10 for electrifier 3, other varieties of lamp, cleaning unit 2, di-electrifier and the like.

Next, in the S132, the operation of high-tension power source circuit 10 for electrifier 3 is made start and the fixed voltage V is applied. Then, the electric potential $E_1$, formed on the surface of photo conductor 1 is measured at the position in the opposite of the surface electric potential sensor 6 with the rotation of the photo conductor 1. Concurrently with it, he photo conductor 1 is made stop (S133). The voltage V loaded on the above electrifier 3 is stored in the microcomputer CPU and the surface electric potential $E_1$ measured with surface electric potential sensor 6 is also stored in CPU with the signal from the same sensor.

The rotation of the photo conductor stops for $\Delta t$ seconds under the condition. The length of the above $\Delta t$ seconds is fixed the same as the first embodiment. Accordingly, the same process as the steps S326, S327 is performed in the potential falling amount revision subroutine of the first embodiment as per the FIG. 2 (*e*) and the surface electric potential $E_1$, $E_2$ of the photo conductor 1 is measured with before and after of an lapse of $\Delta t$ seconds.

At this point in time, the CPU computes the difference between the obtained surface electric potential $E_1$ and that of $E_2$, that is, potential falling amount $\Delta E = E_1 - E_2$ for the duration of $\Delta t$ seconds (S134, S135).

As stated above, the fixed voltage is applied on the electrifier 3 and the charge is loaded on the surface of photo conductor 1 and a means for materializing the function to detect the potential falling amount $\Delta E$ in a fixed time of the charge with surface electric potential sensor 6 is an example of a means for detecting the potential falling amount.

In the next step S136, the temperature T of photo conductor 1 is detected with a thermistor 12. And, in the next step S137, the microcomputer computes as per an example shown below by the selection of, for instance, the revision equation stored in the memory section 11 in accordance with the detected photo conductor temperature T.

That is to say, if the photo conductor temperature T is below 26° C., the potential falling amount $\Delta E$ is corrected on the basis of the below equation and is computed to the corrected potential falling amount $\Delta Ea$.

$$\Delta Ea = |\Delta E - 30| + 22$$

However, | | means the positive numeric process. For instance, if the value of $\Delta E - 30$ is minus, the value is put as 0, and if the value of $\Delta E - 30$ is upwards of 0, then it is left as it is.

And, if the photo conductor temperature T is upwards of 26° C. and below 35° C., then regardless of the potential falling amount $\Delta E$, the corrected potential falling amount $\Delta Ea$ is to be $\Delta Ea = 42$.

Furthermore, if the photo conductor temperature T is upwards of 35° C., the potential falling amount $\Delta E$ is corrected on the basis of the below equation and the corrected potential falling amount $\Delta Ea$ is computed.

$$\Delta Ea = \Delta E - 48$$

Figure 7:
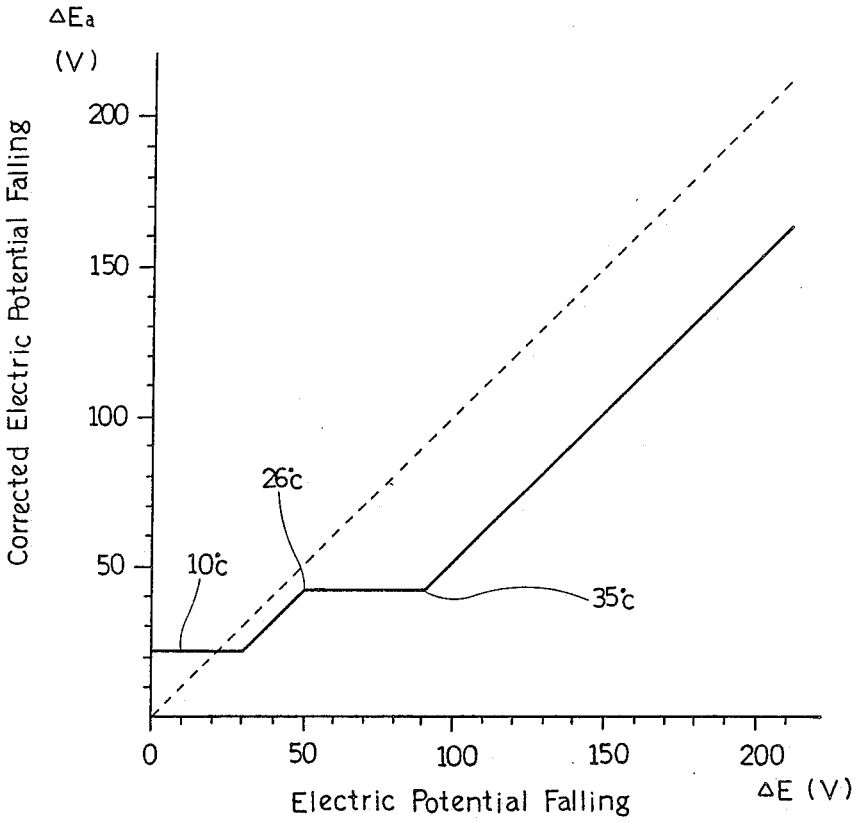

The relation between the potential falling amount $\Delta E$ and the corrected potential falling amount $\Delta Ea$ is shown on a graph of the FIG. 7.

A means for materializing the function to obtain the corrected potential falling amount $\Delta Ea$ by the correction of potential falling amount $\Delta E$ from the selection and application of revisory equation in accordance with the detected temperature of the thermistor 12 for the detection of the aforementioned photo conductor temperature, is an example of the potential falling amount revision means.

In the next step S138, the above corrected potential falling amount $\Delta Ea$ is added on the fixed standard applied voltage $V_0$, and the applied voltage Va of electrifier 3 is computed with the microcomputer CPU.

That is, $$Va = V_0 + \Delta Ea.$$

Figure 11:
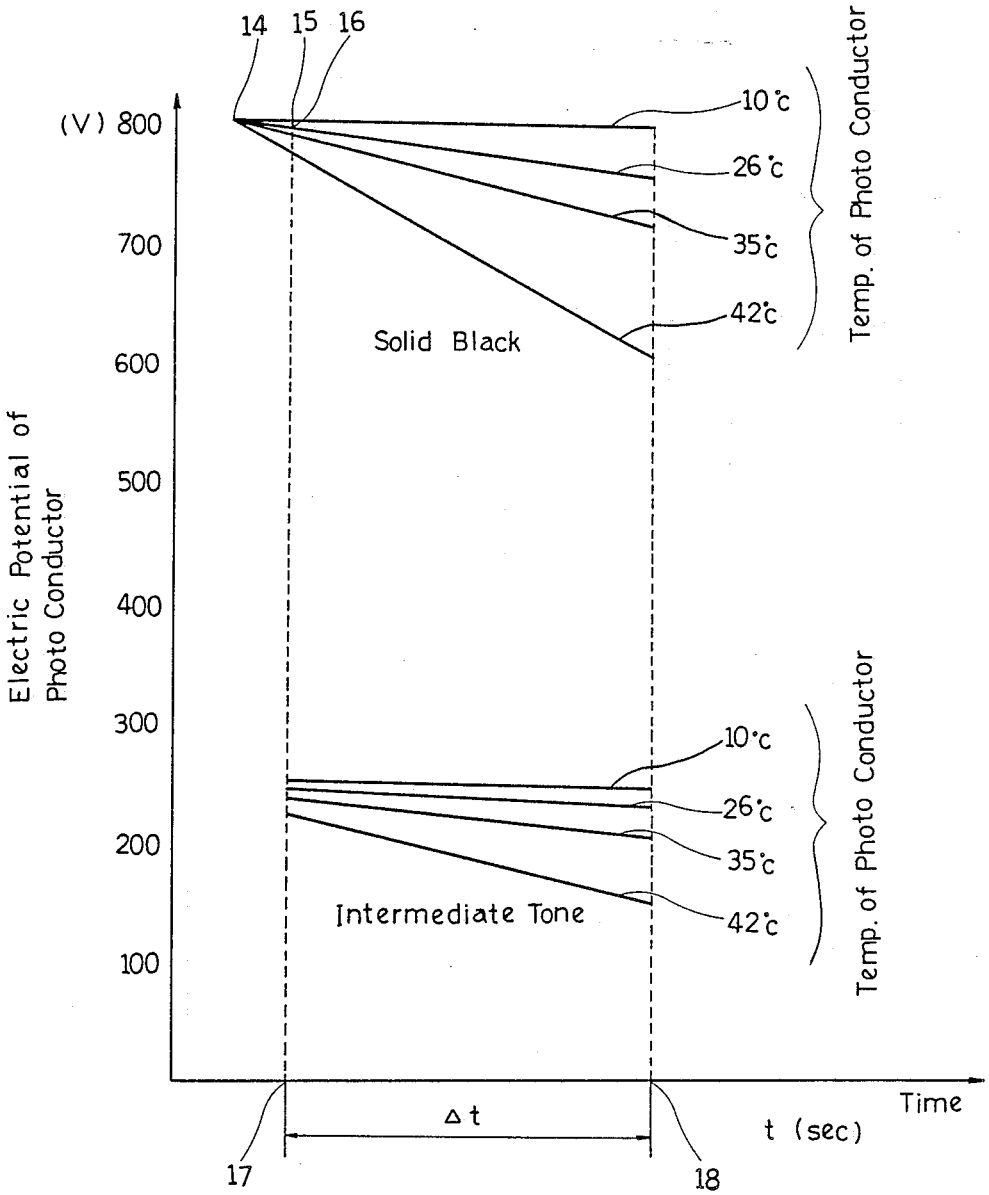

And, the above fixed standard applied voltage $V_0$ is the voltage of electrifier 3 that loads the photo conductor electric potential (for example, 800 V that is appearing No. 14 in the FIG. 11) before the attenuation just after the application of voltage on the electrifier 3.

This fixed standard applied voltage $V_0$ is loaded in a way prearranged, and in consideration of the secular change of photo conductor 1, at the temperature when the amount of potential falling is small, that is, in the periphery of 10° C.–26° C., the voltage is applied to electrifier 3 and memorizing the value of electric potential (e.g. the FIG. 11 Electric potential 15, 16) of the surface of photo conductor detected with the surface electric potential sensor 6 with the rotation of photo conductor 1 by the temperature, the applied voltage may be corrected periodically and automatically by the amount caused by the secular change.

Or, optionally changing the applied voltage at the time of correction automatically, the change in the electric potential of the surface of photo conductor 1 is detected at that point in time and correct anew on the basis of the relation between the applied voltage and the surface electric potential of photo conductor 1 is preferable.

As stated above, a means for materializing the function to figure out the applied voltage Va of electrifier 3 from the addition of the corrected amount of potential falling $\Delta Ea$ to the fixed standard applied voltage $V_0$ is an example of applied voltage computation means.

Figure 8:
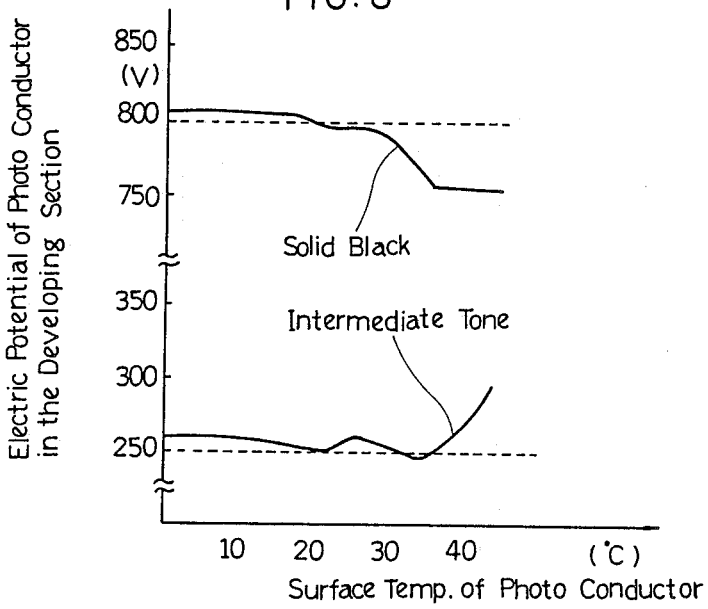
Figure 9:
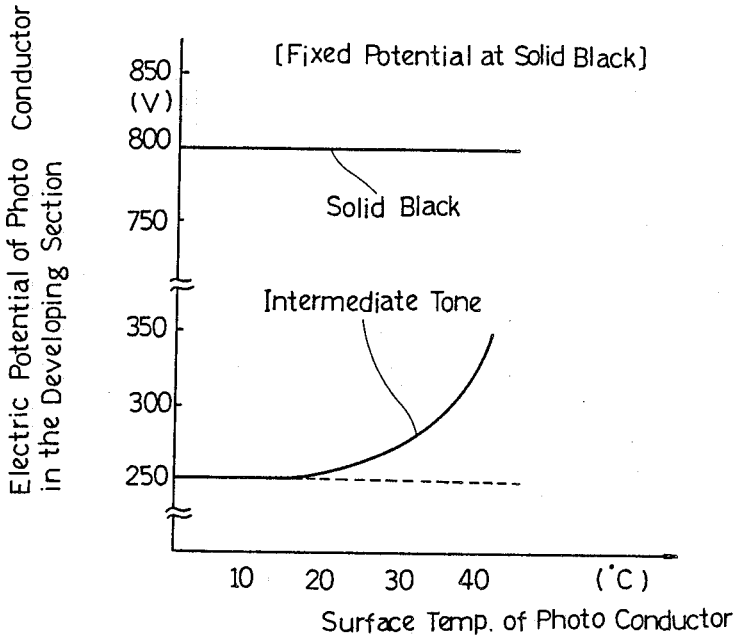
Figure 10:
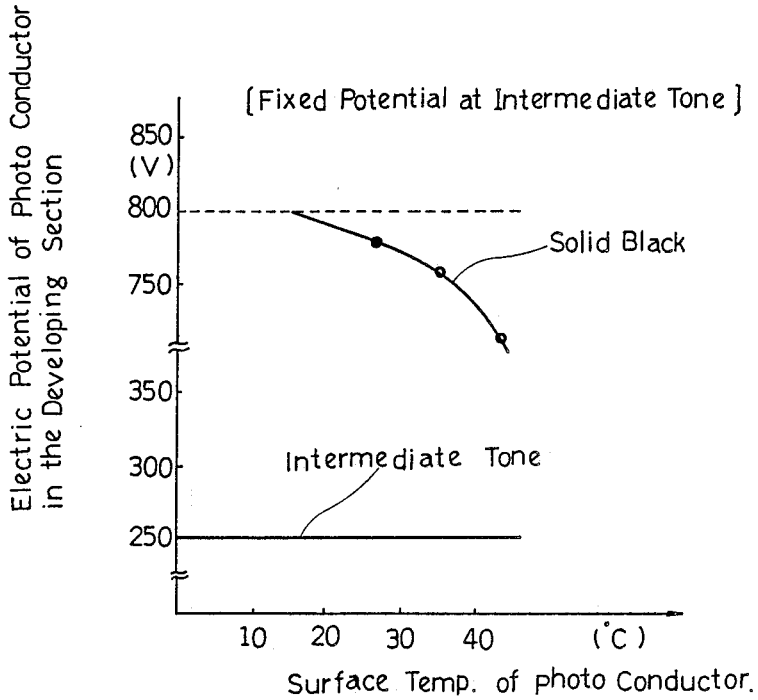

The FIG. 8 shows the electric potential of photo conductor 1 at the developing section at the time when the aforesaid calculated applied voltage Va applied on the electrifier 3 against the photo conductor temperature T.

As shown in this Fig., the photo conductor electric potential of "Solid black" is a variation of 760–810 V and the photo conductor electric potential of "Intermediate tone" is 240–310 V.

Therefore, the photo conductor electric potential to get the preferred image density, for example, is possible to set within the boundary of, 700–900 V for "Solid black" and 210–340 V for "Intermediate tone."

For that reason, in the changes of photo conductor temperature, both of the "Solid black" and "Intermediate tone" can have a respective preferred image density.

Moreover, the aforementioned corrected electric potential amount $\Delta Ea$ is added to the fixed standard applied voltage $V_0$ at it is, and figured out the applied voltage Va, but it may be the case that the value may be added as the another correction that the correction factor as the outcome of the aged deterioration of the photo conductor 1 or the correction factor of the equipment dispersion correction factor and the like.

In succession the undermentioned is the explanation of the preferred still further embodiment in respect of this invention for the electrostatic image formation apparatus. The embodiment will serve to perform the achievement of the aforementioned the fourth object.

Figure 12:
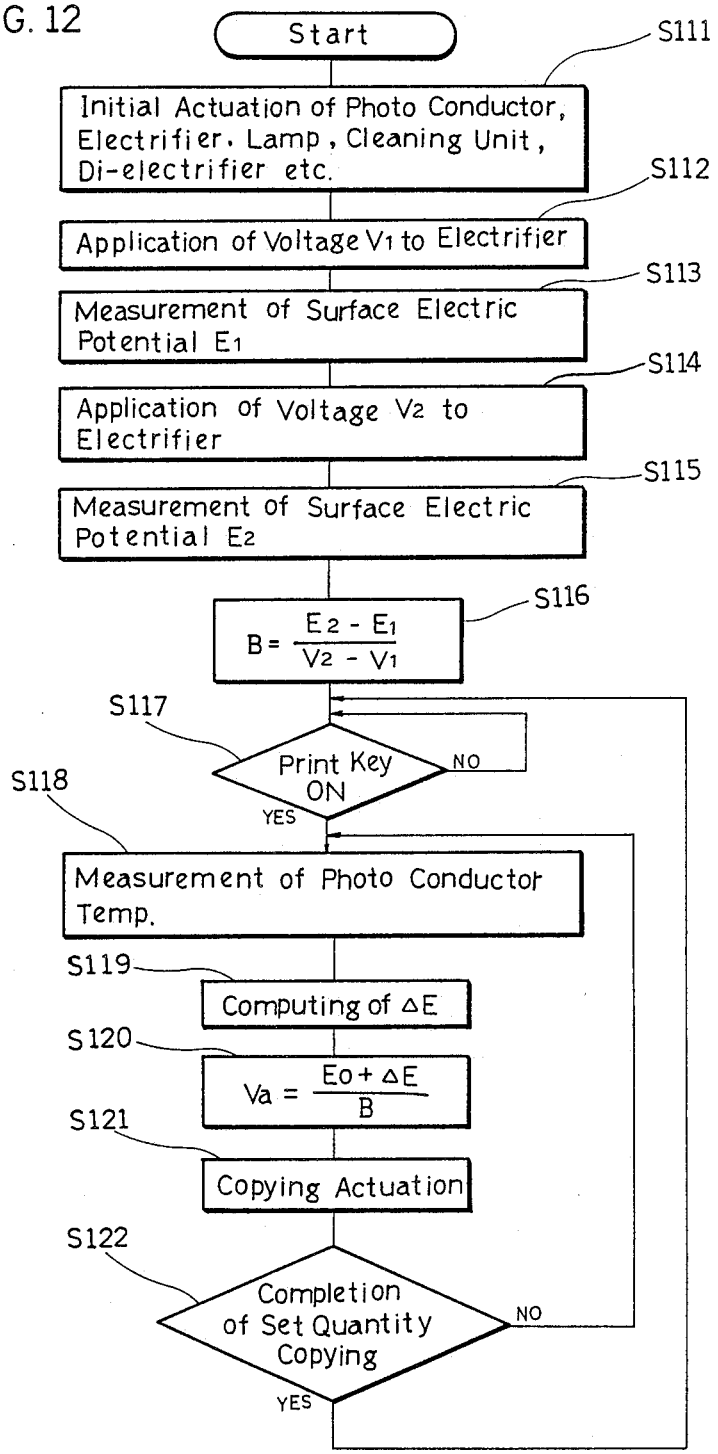

This embodiment differs, compared with the first embodiment, in that the function or table is entered in the storage cell 11 to show the temperature and potential falling characteristics to find the potential falling amount to cope with temperature signal transmitted from thermistor 12 to CPU. The following is the explanation of the control procedures of electrifier 3 with the above microcomputer CPU referring to the FIG. 12. For your reference, the numbers S111, S112, . . . show the number of processing procedures (step).

First, the initial actuation of the electrostatic image formation apparatus 20 starts with the turn on of the power source of the aforesaid electrostatic image formation apparatus 20. And, in the step S111–S115, the first embodiment in the FIG. 2 (*e*) is the same in its process as that of step S321–S325 and the charge capacity B mentioned above is computed.

The charge capacity B will not change by the number of the copied at this point in time, that is 10 sheets, 20 sheets at a time. Therefore, it is fixed to carry out at the time the power source is placed on, but the alternative may be that the above-stated steps S111–S116 are performed before or after the copying at every occasion for the purpose of the precise correction still more. If performed after copying, the charge capacity B can be used for the correction of the next copying.

In the next place, when the print key is turned to "ON" in the step S117, photo conductor temperature T is measured by thermistor 12 (S118) and on the basis of this photo conductor temperature, the corrected potential falling amount ΔE is computed (S119). In the computation of the potential falling amount ΔE, reference is made to the photo conductor temperature vs. potential falling characteristics memorized beforehand in storage cell 11.

Figure 13:
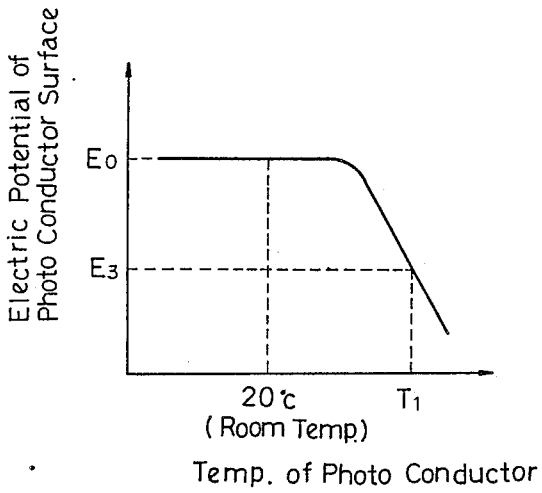

This photo conductor temperature vs. potential falling characteristics has a characteristics as shown in the FIG. 13, for instance, if the photo conductor temperature is $T_1$, potential falling amount ΔE is shown as $\Delta E = E_0 - E_3$.

And the above photo conductor temperature vs. potential falling characteristics is stored in storage cell 11 as the function or the table. This is adjusted to get the desired appropriate electric potential $E_0$ after t hours (the time necessary for the surface of a certain photo conductor to reach from the location of the electrifier 3 to the developing section 5') at the time when electrifier voltage $V_0$ is applied on the surface of photo conductor 1 at ordinary temperature (20° C.).

Furthermore, in the step 120, same as the first embodiment, the voltage Va is computed to load on the electrifier 3 necessary to generate electric potential $E_0$ to cope with the charge obtained at the developing section 5'.

And this Va is applied on the electrifier 3 by way of high-tension power source circuit 10 and copying action takes place (S121), and a judge is made whether the copying of the first arranged number of sheets to be copied is over or not with S122, and if finished, the procedure returns to S117 where it is waiting for new input of print key. If not finished, returning to S118, the S118 and the followings is repeated until the fixed number of sheets is over. At this point in time the rise in temperature of the photo conductor 1 will not cause a disorder in the surface electric potential, because the photo conductor temperature is measured one after another in the S118 and the potential falling amount is corrected in the manner as stated above and the voltage Va of electrifier 3 is changed accordingly.

This invention does not deviate from the spirit or the essential characteristics and can be performed or materialized in the other embodiment.

Therefore, the above-mentioned methods are those of the preferred examples, but not to be limited only to the above.

Moreover, the scope of the invention shown in the claim to be attached herewith and the alterations caused in the category of the claim give meaning totally to the claim.

What is claimed is:

1. An electrostatic image forming apparatus in which a photo conductor is charged by an electrifier provided in the vicinity of the photo conductor rotating, an electrostatic latent image is formed by projecting light to said charge, and said electrostatic latent image is developed into a toner image by applying toner thereto at a developing section, said apparatus comprising:

voltage adjusting means for applying first and second voltages ($V_1$, $V_2$) to charge said electrifier in order to charge first and second positions on a surface of said photo conductor, electric potential detecting means for detecting electric potentials ($E_1$, $E_2$) at said first and second positions on the surface of a photo conductor that corresponds to the first and second voltages ($V_1$, $V_2$) by means of a single surface electric potential sensor installed in the neighborhood of a surface of the photo conductor, potential difference detecting means for detecting a potential difference (ΔE) between said second electric potential and a third electric potential on a surface of said photo conductor detected at said second position when said photo conductor is stopped for a predetermined time, and voltage computing means for calculating the voltage to be applied to said electrifier according to said first and second voltages ($V_1$, $V_2$), said detected first and second electric potentials ($E_1$, $E_2$) and said potential difference (ΔE) whereby said surface charge on said photo conductor is adjusted to a required amount.

2. An electrostatic image forming apparatus according to claim 1, further comprising:

photo conductor temperature detecting means for measuring the photo conductor temperature (T) installed in the neighborhood of the surface of the photo conductor and memory means for storing a function or table in advance to show the relationship of the temperature of the photo conductor versus potential difference characteristics and said voltage computing means further calculates said voltage to be applied in response to said photo conductor temperature (T) and said function or table.

3. An electrostatic image forming apparatus in which a photo conductor is charged by an electrifier provided in the vicinity of the photo conductor rotating, an electrostatic latent image is formed by projecting light to said charge, said electrostatic latent image is developed into a toner image by applying toner thereto at a developing section, said apparatus comprising:

potential difference detecting means for detecting the amount of potential difference in a specified time of the charge with the use of a single surface electric potential sensor which is installed in the periphery of the surface of the photo conductor after charging the surface of the photo conductor by said electrifier applied specified voltage, potential difference revision means for revising the amount of potential difference detected by said potential difference detecting means by selecting to apply the revised expression in accordance with the detected temperature by a temperature sensor in detecting said photo conductor temperature, and applied voltage computation means for computing the applied voltage of said electrifier by adding the revised amount of potential difference by way of said potential difference amount revision means onto the specified standard applied voltage.

* * * * *